US010865514B2

(12) United States Patent
Schwab

(10) Patent No.: US 10,865,514 B2
(45) Date of Patent: Dec. 15, 2020

(54) VENT ATTACHMENT FOR USE IN DRYING ARTICLES OF CLOTHING AND THE LIKE

(71) Applicant: Mark Schwab, Lancaster, WI (US)

(72) Inventor: Mark Schwab, Lancaster, WI (US)

( * ) Notice: Subject to any disclaimer, the term of this patent is extended or adjusted under 35 U.S.C. 154(b) by 0 days.

(21) Appl. No.: 16/274,642

(22) Filed: Feb. 13, 2019

(65) Prior Publication Data

US 2020/0256007 A1 Aug. 13, 2020

(51) Int. Cl.
*D06F 59/04* (2006.01)
*F26B 21/00* (2006.01)

(52) U.S. Cl.
CPC ..... *D06F 59/04* (2013.01); *F26B 21/008* (2013.01)

(58) Field of Classification Search
CPC ..... D06F 59/04; D06F 59/00; F26B 21/00; F26B 21/06; F26B 21/008
USPC ..... 34/239
See application file for complete search history.

(56) References Cited

U.S. PATENT DOCUMENTS 4,653,289 A 3/1987 Hodgetts
4,892,137 A 1/1990 Bibik, Jr.
4,991,756 A 2/1991 Benjamin
5,115,580 A 5/1992 Blumenfeld et al.
5,406,717 A * 4/1995 Dofka ..... D06F 59/04 211/37
5,604,993 A * 2/1997 Auckerman ..... D06F 59/04 219/211
5,720,108 A * 2/1998 Rice ..... A47L 23/205 34/104
5,913,452 A 6/1999 Weigl
5,961,083 A 10/1999 Hartmann et al.
5,983,518 A 11/1999 Ellenburg
6,085,436 A * 7/2000 Peet ..... D06F 59/04 223/78
6,499,227 B1 * 12/2002 Jacobson ..... D06F 59/04 34/104
6,533,232 B1 3/2003 Aggeler
6,560,933 B2 5/2003 Shcimmeyer
7,121,017 B2 * 10/2006 DuRapau ..... A47L 23/205 34/381
7,328,523 B2 * 2/2008 Vossoughi ..... A47L 13/18 34/90
7,716,849 B1 5/2010 Hicks
8,079,156 B1 12/2011 Parish
8,365,431 B1 2/2013 Parish
9,856,597 B2 1/2018 Smoots
2002/0138953 A1 * 10/2002 Passafiume ..... A45F 5/00 24/306
2003/0009902 A1 * 1/2003 Kirk ..... A47L 23/20 34/104

(Continued)

*Primary Examiner* — Stephen M Gravini
(74) *Attorney, Agent, or Firm* — Boyle Fredrickson, S.C.

(57) ABSTRACT

An air vent attachment, such as for drying articles of clothing is provided. The air vent attachment includes a cage member having at least one air conduit extending from an inner surface to an outer surface, the inner surface abutting an exterior surface of an air vent and the outer surface distanced from the exterior surface of the air vent. A securing rod has an inner end and an outer end, the inner end having a securing member and the outer end retaining the cage member. A biasing member is positioned between the cage member and the outer end of the securing rod to bias the cage member toward the inner end of the securing rod.

20 Claims, 7 Drawing Sheets

(56) References Cited

U.S. PATENT DOCUMENTS

| | | | | |
|---|---|---|---|---|
| 2003/0173478 | A1* | 9/2003 | Williams | D06F 59/04 248/176.1 |
| 2003/0213144 | A1* | 11/2003 | Jacobson | D06F 59/04 34/427 |
| 2005/0120579 | A1* | 6/2005 | Nicholson | A63B 71/146 34/106 |
| 2005/0262719 | A1* | 12/2005 | Calbreath | F26B 23/001 34/239 |
| 2007/0193059 | A1* | 8/2007 | Carey | F26B 9/003 34/229 |
| 2008/0083131 | A1* | 4/2008 | Wess | D06F 59/04 34/239 |
| 2009/0072106 | A1 | 3/2009 | Zheng | |
| 2009/0100699 | A1* | 4/2009 | Hasler | D06F 59/04 34/106 |

* cited by examiner

VENT ATTACHMENT FOR USE IN DRYING ARTICLES OF CLOTHING AND THE LIKE

CROSS-REFERENCE TO RELATED APPLICATION

Not Applicable

BACKGROUND AND SUMMARY

This invention relates to an attachment for an air vent that may be used to dry articles of clothing and the like.

Many outdoor activities such as shoveling and cold weather sports like skating, skiing, sledding, snowboarding, and snowmobiling require users to wear clothing items on their heads, hands, and feet for warmth and insulation. For example, users often wear winter hats, gloves, mittens, and socks to cover their extremities. Other outdoor sports require users to wear these clothing items for better performance. For example, golf gloves are often worn for better grip of a golf club.

The outdoor environment can cause such clothing items, even weatherproof or weather resistant clothing items, to lose their warmth, insulation and gripping functions. For example, rain or snow can cause clothing articles to get damp or even soaked through to the interior of the article, resulting in loss of insulation and warmth. Wet articles of clothing can also get slippery resulting in loss of its gripping function. As such, there is a need for quick and convenient drying of such clothing items.

The present invention recognizes that most buildings and automobiles have ventilation air vents that are used to circulate warm or cold air through the building or vehicle. Most air vents have louvers or vanes for controlling the horizontal orientation of air emitted from the air vent and/or for controlling the vertical orientation of air emitted from the air vent. The vanes can typically also be opened or closed to allow or block air from being emitted from the air vents. The air vents provide a convenient source of airflow that can be used to dry the clothing articles mentioned above.

In accordance with one aspect of the present invention, an air vent attachment includes a cage member having at least one air conduit extending between an inner surface and an outer surface, the inner surface abutting an exterior surface of an air vent and the outer surface distanced outwardly from the exterior surface of the air vent. A securing rod has an inner end and an outer end, the inner end having a securing member securing the rod to the air vent and the outer end retaining the cage member to the rod. A biasing member is positioned between the cage member and the outer end of the securing rod to bias the cage member toward the inner end of the securing rod.

In accordance with another aspect of the present invention, an air vent attachment includes a cage member having at least one air conduit extending from an inner surface to an outer surface, the inner surface abutting an exterior surface of an air vent and the outer surface distanced from the exterior surface of the air vent. The inner and outer surfaces of the cage member are formed by opposed outer frame portions extending opposite and substantially parallel to each other and a number of support bars extending therebetween the opposed outer frames. A securing member retains the cage member against the exterior surface of the air vent.

In accordance with another aspect of the present invention, a method of drying an article of clothing includes the acts of providing a vent attachment having a cage member having at least one air conduit permitting the flow of air from an inner surface to an outer surface; a securing rod having an inner end and an outer end, the inner end having a securing member and the outer end retaining the cage member; and a biasing member positioned between the cage member and the outer end of the securing rod to bias the cage member toward the inner end of the securing rod. The inner surface of the cage member is placed against an exterior surface of an air vent. The securing rod is employed to secure the vent attachment to the air vent. An article of clothing is placed around or over the cage member to allow air to flow into an opening of the article of clothing providing access to an interior of the article of clothing.

In one embodiment, the securing rod extends through the cage member and the cage member is slidable with respect to the securing rod. At least one of the inner and outer surfaces of the cage member may support a central hole or opening supporting extension of the securing rod therethrough. A width of the securing rod may be sized to fit between vanes of the air vent. The securing member may be a hook. The outer end of the securing rod may carry an outer handle.

The securing rod may allow the cage member to be attached to many different sizes and shapes of air vents and air vent vanes.

In one embodiment, the biasing member is a spring coil extending around the securing rod.

The inwardly biased engagement mechanism allows for the cage member to be quickly attached to the exterior surface of the air vent with enough force to retain the article of clothing to the air vent without the cage member disengaging from the air vent.

In one embodiment, the cage member is frustoconical in shape where a broader end carries the inner surface and the narrower end carries the outer surface. The inner and outer surfaces of the cage member may be circular frames extending opposite and substantially parallel to each other with a number of support bars extending between the circular frames.

The cage-like construction of the cage member allows air to flow around and through the cage member so that the air flows into all cavities and recesses of the clothing item. The broad cage member also supports expansion of the clothing item to open up all the cavities and recesses of the clothing item to air flow.

Other aspects, features and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and the construction and operation of typical mechanisms provided with the present invention, will become more readily apparent by referring to the exemplary, and therefore non-limiting, embodiment illustrated in the drawings accompanying and forming a part of this specification, wherein like reference numerals designate the same elements can be several views, and in which.

Figure 1:
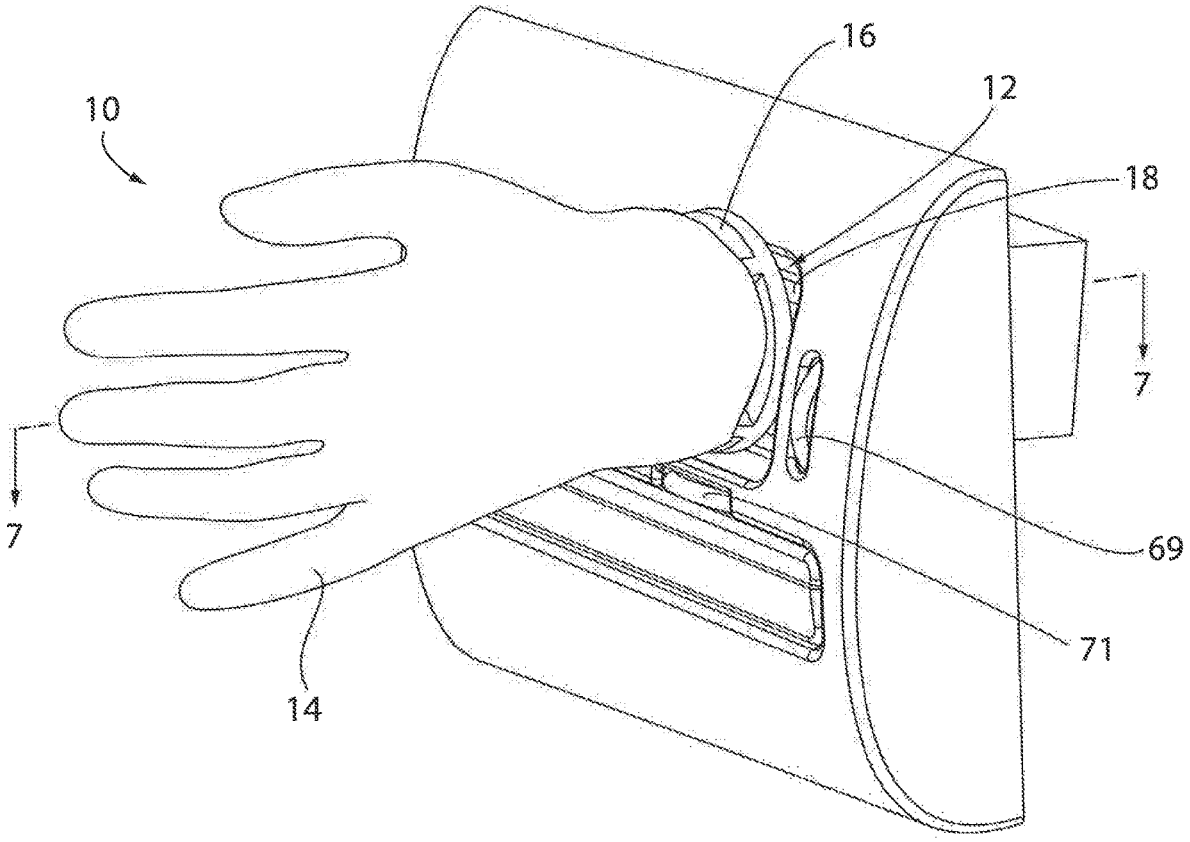
FIG. 1 is a perspective view of the vent attachment attached to an automobile air vent and a glove attached to the vent attachment, in accordance with one embodiment of the present invention.

In describing the embodiments of the invention, which are illustrated in the drawings, specific terminology will be resorted to for the sake of clarity. However, it is not intended that the invention be limited to the specific terms so selected and it is to be understood that each specific term includes all technical equivalents, which operate in a similar manner to accomplish a similar purpose. For example, the words "connected," "attached," or terms similar thereto are often used. They are not limited to direct connection or attachment, but include connection or attachment to other elements where such connection or attachment is recognized as being equivalent by those skilled in the art.

DETAILED DESCRIPTION

The various features and advantageous details of the subject matter disclosed herein are explained more fully with reference to the non-limiting embodiments described in detail in the following description.

FIG. 1 illustrates a vent attachment 10 in accordance with a first embodiment of the present invention used in connection with an automobile air vent 12 for drying a glove 14 placed thereon. As shown, the vent attachment 10 is releasably attached to the automobile air vent 12 and the glove 14 is extended over the vent attachment 10 for drying of an interior cavity of the glove 14.

Figure 2:
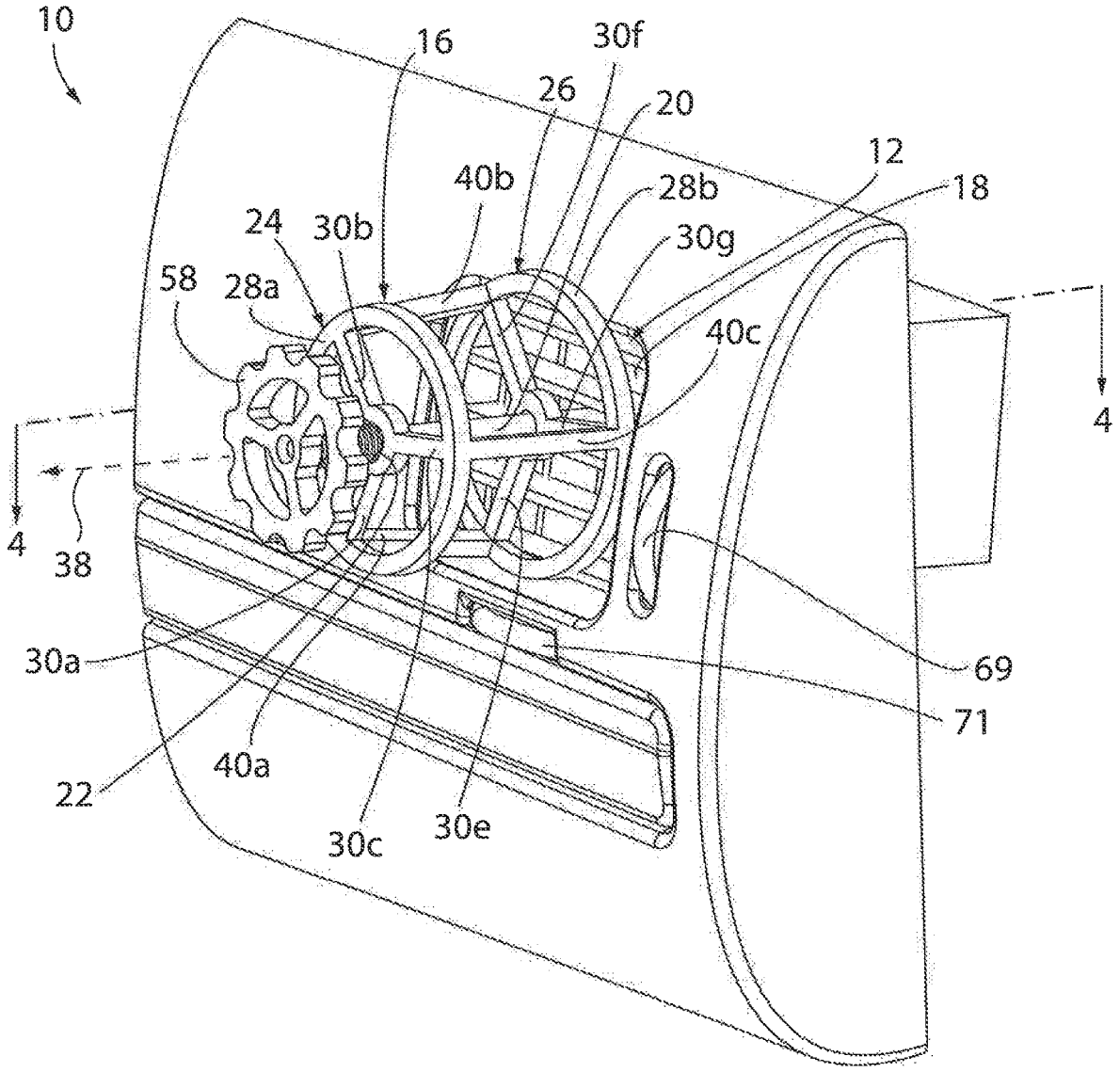
FIG. 2 is a view similar to FIG. 1 showing the glove removed exposing the vent attachment.

FIG. 2 illustrates the vent attachment 10 of FIG. 1 with the glove 14 removed so as to expose the vent attachment 10. In one embodiment, the vent attachment 10 is comprised of an assembly including a base frame 16 abutting an outer surface or exterior surface 18 of the automobile air vent 12 and retained in position by a securing rod 20 attached to the air vent 12 and the base frame 16 biased inwardly toward the exterior surface 18 of the automobile air vent 12 by a coil spring 22.

Figure 3:
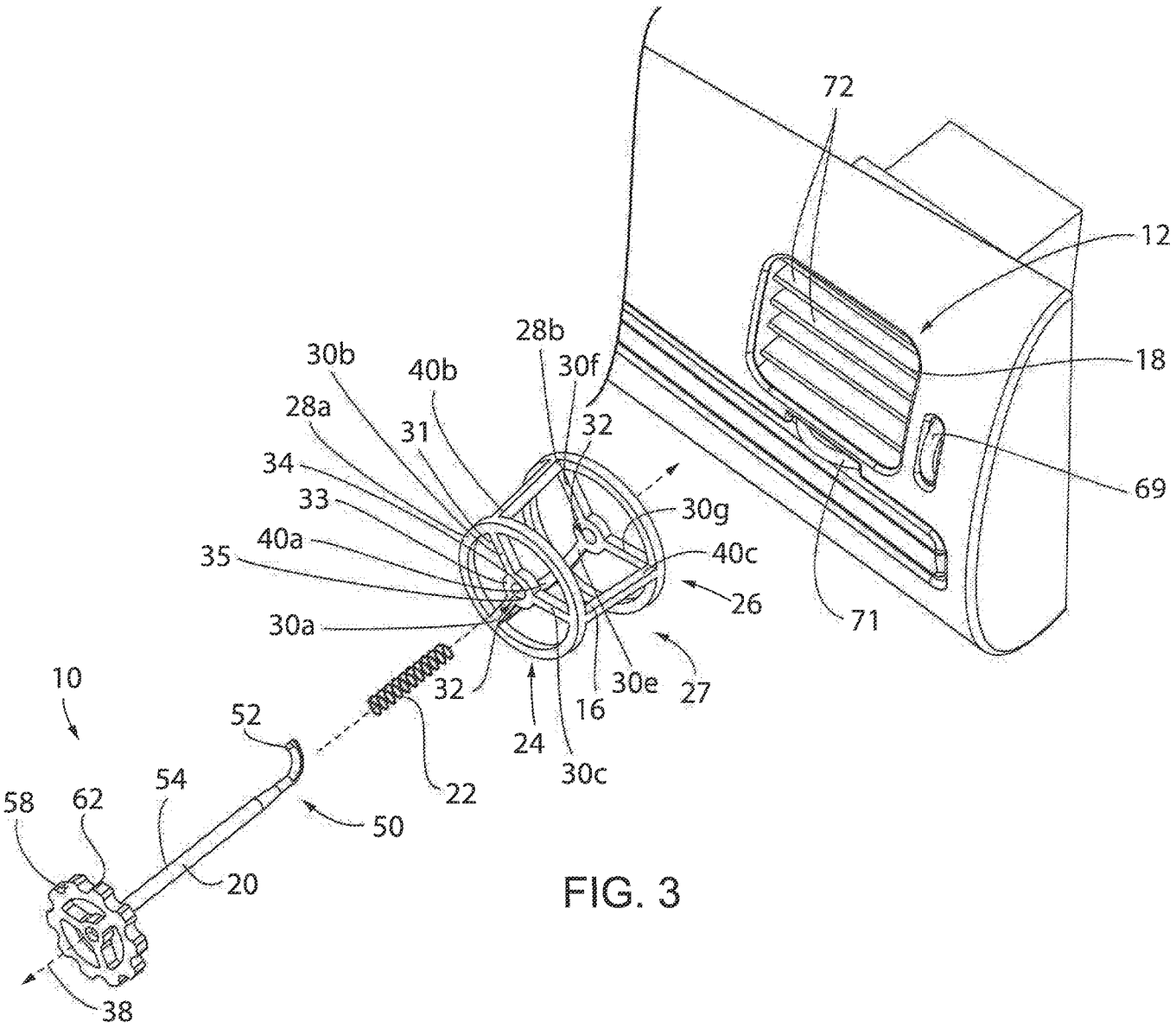
FIG. 3 is a view similar to FIG. 2 showing an exploded view of the vent attachment where the securing rod receives a coil spring and a frame body.

FIG. 3 illustrates the vent attachment 10 of FIG. 2 where the vent attachment 10 is in an exploded view to show the assembly of the base frame 16, securing rod 20, and the coil spring 22.

The base frame 16 provides a frustoconical shaped cage allowing air to flow therethrough while also supporting the glove 14 thereon. In this respect, multiple air conduits are provided through the base frame 16 allowing air to flow through. The base frame 16 has an outer circular base 24 opposite an inner circular base 26. The outer circular base 24 is smaller in area than the inner circular base 26, and the outer and inner circular bases 24, 26 extend along parallel planes that are spaced in separation by a curved outer surface 27 of the base frame 16 to form a frustum of a cone.

The outer and inner circular bases 24, 26 are defined by outer rings 28*a*, 28*b*, respectively, similar to a rim or outer edge of a wheel, and defining a perimeter of the outer and inner circular bases 24, 26, respectively. The outer rim 28*a* of the outer circular base 24 has a diameter that is less than a diameter of the inner rim 28*b* of the inner circular base 26.

Extending inwardly from each of the outer rims 28*a*, 28*b* of the outer and inner circular bases 24, 26 to a center of the outer and inner circular bases 24, 26 are three spokes 30*a*, 30*b*, 30*c* of the outer rim 28*a*, and three spokes 30*e*, 30*f*, 30*g* of the inner rim 28*b*, spaced equally around the perimeters of the outer and inner circular bases 24, 26, respectively. Each of the spokes 30 has an outer end 31 attached to the outer rim 28 and an inner end 33 attached to a center hub 32. The spokes 30*a*, 30*b*, 30*c* of the outer circular base 24 are generally equal in length while the spokes 30*e*, 30*f*, 30*g* of the inner circular base 26 are generally equal in length. The spokes 30*a*, 30*b*, 30*c* of the outer circular base 24 and shorter than the spokes 30*e*, 30*f*, 30*g* of the inner circular base 26 since the diameter of the outer circular base 24 is less than the diameter of the inner circular base 26. It is understood that different numbers of spokes 30 may be provided about each rim 28, such as two, four, or five or more.

A center hub 32 is positioned at the center of both the outer and inner circular bases 24, 26, carried by the spokes 30, and defined by a ring 34 that defines a central hole 35. The holes 35 of the outer and inner circular bases 24, 26 extend along a common axis 38. The spokes 30 of the circular bases 24, 26 are generally aligned along planes intersecting the axis 38 in a cross or star-like formation.

The outer and inner circular bases 24, 26 are joined by three equally spaced support rods 40 extending between the outer rims 28*a*, 28*b* of the outer and inner circular bases 24, 26. The support rods 40*a*, 40*b*, 40*c* may generally extend between the outer rims 28*a*, 28*b* at positions where the outer ends 31 of the spokes 30 meet the outer rims 28*a*, 28*b*. The support rods 40*a*, 40*b*, 40*c* are angled outwardly from the outer rim 28*a* to the outer rim 28*b* to define the curved outer surface 27 of the frustoconical shaped cage. A central space between the support rods 40*a*, 40*b*, 40*c* and between the center spokes 32 of the outer and inner circular bases 24, 26 is clear from obstruction to allow the securing rod 20 to extend therethrough as further described below. It is understood that different numbers of support rods 40 may be provided, such as two, four, or five or more.

Figure 7:
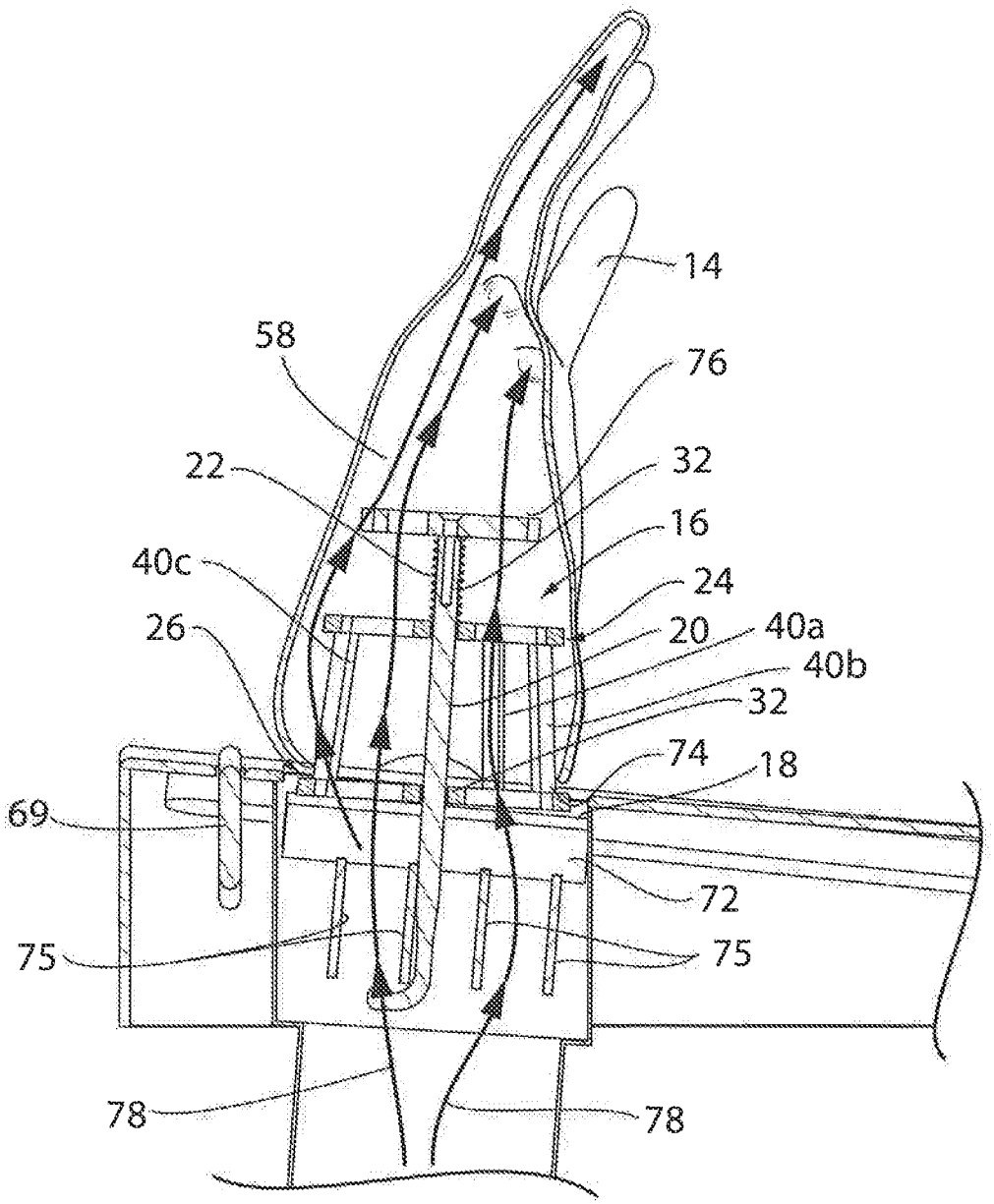
FIG. 7 is a cross sectional view of FIG. 1 shown along lines 7-7 showing airflow through the vent attachment and into a glove extending over the frame body.

The securing rod 20 is defined by an inner end 50 carrying an L-shaped or shaped hook 52 extending to a center portion 54 defined by a straight section and further extending to an outer end 56, The outer end 56 carries a handle 58 extending perpendicular to the center portion 54 and defined by a circular disk having a diameter greater than the securing rod 20 with teeth 62 on an outer perimeter of the disk to provide a gear shape handle 58 for gripping. The handle 58 may be attached to the center portion 54 of the securing rod 20 by a screw extending into the center portion 54 as seen in FIG. 7. It is understood that the securing rod 20 may be slightly narrowed between the center portion 54 and the J-shaped hook 52.

The coil spring 22 is installed around the center portion 54 of the securing rod 20 to abut the handle 58 (the handle 58 retains the coil spring 22 on the securing rod 20) on one end and the base frame 16 (the base frame 16 retains the coil spring 22 on the securing rod 20) on the other end. The base frame 16 is installed around the center portion 54 of the securing rod 20 to abut the coil spring 22 on one end and to abut and be retained by the J-shaped hook 52 on the other end.

The securing rod 20 is inserted through the central holes 35 of the outer and inner circular bases 24, 26 of the base frame 16 such that the outer circular base 24 abuts the coil spring 22 and the inner circular base 26 is retained by the J-shaped hook 52 on the securing rod 20. The size of the central holes 35 is slightly larger than the securing rod 20 to allow the securing rod 20 to freely slide therethrough. The securing rod 20 may need to be manipulated in order to initially slide the J-shaped hook 52 of the securing rod 20 through the central holes 25, or the hook 52 may be formed or applied on or to the end of the securing rod 20 after the securing route 20 has been inserted through the central holes 25.

A tension of the coil spring 22 may generally correspond with a tension allowing the base frame 16 to be pressed toward the handle 58 by approximately 3-5 inches, thus allowing the inner end 50 carrying the J-shaped hook 52 to be extended approximately 2-4 inches into the air vent 12.

Figure 4:
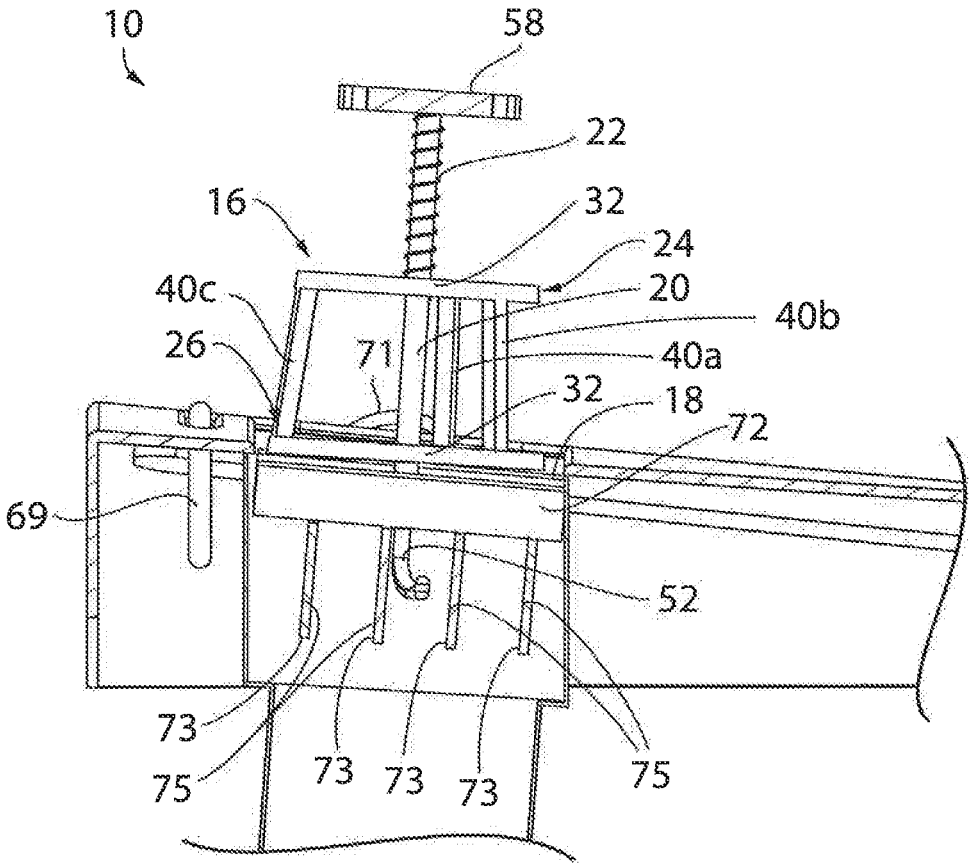
FIG. 4 is a cross section view of FIG. 2 shown along lines 7-7 showing the vent attachment attached to the automobile air vent where the frame body abuts the exterior surface of the automobile air vent and the securing rod is inserted into the automobile air vent.

Referring to FIG. 4, the vent attachment 10 is installed on the automobile air vent 12. In one embodiment, as shown, vanes 72 of the air vent 12 extend horizontally to provide horizontal fans of air and vanes 75 extend vertically to provide vertical fans of air.

The vent attachment 10 is attached to the automobile air vent 12 by placing the inner circular base 26 of the base frame 16 against the exterior surface 18 of the automobile air vent 12 while the outer circular base 24 is spaced outwardly from the exterior surface 18. While the base frame 16 is held against the exterior surface 18, the user manipulates the securing rod 20 to insert the J-shaped hook 52 between adjacent vanes 72, 75 of the automobile air vent 12. The vanes 72, 75 are generally placed in an open position (by turn wheels 69, 71, respectively) to facilitate the securing rod 20 being advanced into the automobile air vent 12.

The orientation of the J-shaped hook 52 may be so that the J-shaped hook 52 will more easily fit between the vanes 72, 75. For example, for horizontal vanes 72 that extend horizontally, the J-shaped hook 52 is oriented to extend sideways (left or right) to provide a narrowed height. For vertical vanes 75 that extend vertically, the J-shaped hook 52 is oriented to extend upwards or downwards to provide a narrowed width.

Figure 5:
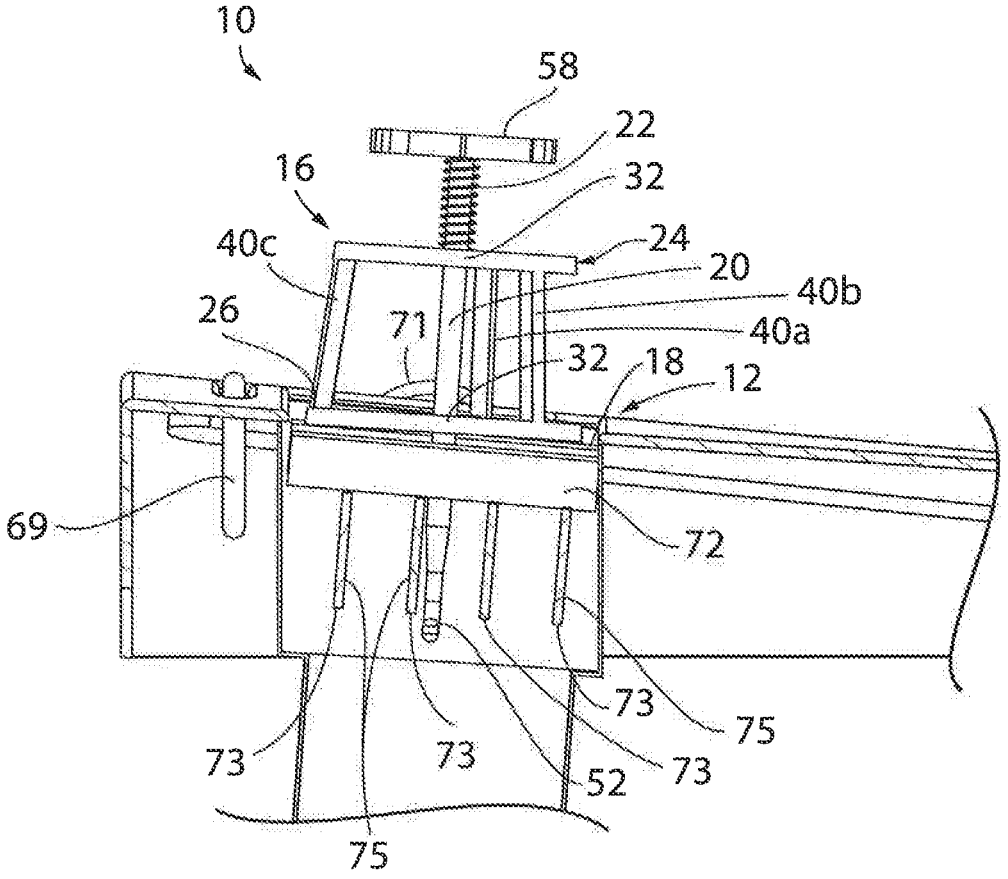
FIG. 5 is a view similar to FIG. 3 showing the vent attachment attached to the automobile air vent where the securing rod is extended past a rear edge of the vanes of the automobile air vent.

Referring to FIG. 5, the J-shaped hook 52 is further extended deeper along a depth of the vanes 72, 75 in a direction generally perpendicular to the exterior surface 18 of the automobile air vent 12. While the J-shaped hook 52 is extended into the automobile air vent 12 the coil spring 22 is compressed between the handle 58 and the base frame 16 to provide an inward force against the exterior surface 18 of the automobile air vent 12. In one embodiment, the securing rod 20 is extendible and collapsible, and then locked in length, to provide a longer or shorter length of the rod 20 in accordance with the size and shape of the vanes 72, 75.

Figure 6:
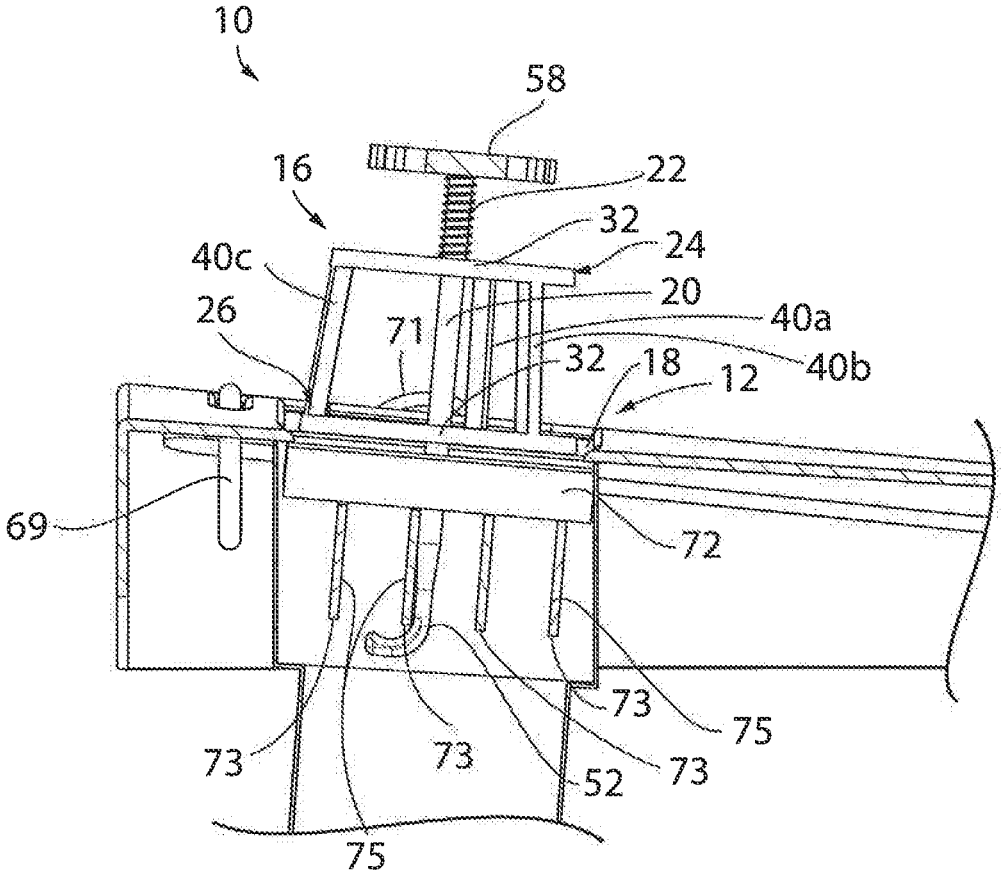
FIG. 6 a view similar to FIG. 3 showing the vent attachment attached to the automobile air vent where the securing rod is rotated to hook onto the rear edge of the vanes of the automobile air vent.

Referring to FIG. 6, once the J-shaped hook 52 is extended beyond a rear edge 73 of the rearmost vertical vanes 75, the J-shaped hook 52 is rotated approximately 90 degrees in order to hook the J-shaped hook 52 around the rear edge 73 of an adjacent vane 75. Once the hook 52 is in this position, the inward pressure on the rod 20 is relieved, which enables the coil spring 22 to extend, thus applying an outward force on the hook 52. At the same time, the spring 22 applies an inward force on the base frame 16 against the exterior surface 18 of the automobile air vent 12. Together, the outward force on hook 52 and inward force on base frame 16 function to clamp the vent attachment 10 is to the automobile air vent 12. In the embodiment shown, the J-shaped hook 52 is rotated from an upward position to a sideways position to couple the hook 52 to the adjacent vertical vane 75. It is understood that if the rearmost vanes were horizontal vanes 72, the J-shaped hook 52 is rotated from a sideways position to an upward or downward position to couple the hook 52 to the adjacent horizontal vane 72.

Referring to FIG. 7, the glove 14 is placed over the base frame 16 such that the base frame 16 extends into an opening 74 of the glove 14 and is received by an interior cavity 76 of the glove 14. The base frame 16 receives the glove 14 such that the opening 74 of the glove 14 is advanced toward the exterior surface 18 of the automobile air vent 12 to capture airflow 78 emanating from the automobile air vent 12 without allowing air to escape.

In one embodiment, the glove 14 is snugly fit over the base frame 16 to prevent the glove 14 from falling off the base frame 16. In another embodiment, the opening 74 of the glove 14 may be coupled to the exterior surface 18 of the automobile air vent 12, for example by a clip or adhesive, to prevent the glove 14 from being removed from the base frame 16 by the airflow 78. The base frame 16 extends approximately 2-4 inches, into the interior cavity 76 to expand the interior cavity 76 and open up the smaller cavities (for the fingers) of the glove 14.

As seen in FIG. 7, the airflow 78 flows from an air source such as a fan or blower of the automobile air vent 12 and outward through the vanes 72, 75 of the automobile air vent 12 when the vanes 72, 75 are in the open position. The airflow 78 may be heated or cooled as understood in the art. The airflow 78 continues into the interior cavity 76 of the glove 14 to dry any moisture or wetness of the interior of the glove 14.

It is understood that the shape of the base frame 16 provides a broad structure for carrying the glove 14 thereon in an expanded state allowing airflow 78 into the cavities of the glove 14. In alternative embodiments, the base frame 16 may be cylindrical, spherical, or rectangular in shape.

It is also understood that the multiple air conduits extending between the outer and inner circular bases 24, 26 of the base frame 16 allow air to flow freely between the inner circular base 26 and the outer circular base 24, and around the outer rims 28*a*, 28*b*; spokes 30; center hub 32; and support rods 40*a*, 40*b*, 40*c* of the base frame 16. The airflow 78 within the glove 14 allows for quick and convenient drying of the glove 14.

It is also understood that the coil spring 22 provides an inward biasing force on the base frame 16 against the exterior surface 18 of the automobile air vent 12 to retain the base frame 16 perpendicular to the exterior surface 18 of the air vent 12 against the downward weight of the glove 14 on the base frame 16. The tensioning of the coil spring 22 also allows the vent attachment 10 to fit different sizes of automobile air vent 12 and in particular, vanes 72, 75 of different depths and thicknesses.

Although the vent attachment 10 is shown being attached to an automobile air vent 12, it is understood that the vent attachment 10 can be attached to any air vent, including, but not limited to, a conventional forced-air wall vent in a home or other building, or to a fan, dryer or the like having an outlet with vanes or other airflow directing structure. In this regard, while the invention is shown and described with the work being engaged with vanes such as 72, 75, it can be appreciated that the hook may also be engaged with any other structure of the air vent that enables airflow from the air vent to pass into and through the vent attachment 10. Such structure may include, for example, fixed-position fins or louvers at the outlet of the air vent or any other satisfactory structure. And while the vent attachment 10 is illustrated as being used in connection with drying a glove 14, the vent attachment 10 can be used to dry any article of clothing having an interior cavity 74, such as hats, mittens, socks, etc.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It is also understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

I claim:

1. An air vent attachment comprising:

a cage member having at least one air conduit extending from an inner surface to an outer surface, the inner surface abutting an exterior surface of an air vent and the outer surface distanced outwardly from the exterior surface of the air vent;

a securing rod movably interconnected with the cage member and having an inner end and an outer end, the inner end having a securing member and the outer end retaining the cage member, wherein the securing rod is movable relative to the cage member between an extended position and a retracted position, wherein when the securing rod is in the extended position the securing member extends past the inner end of the cage member; and a biasing member positioned between the cage member and the securing rod, wherein the biasing member acts to bias the cage member toward the retracted position;

wherein when the inner surface of the cage member abuts the exterior surface of the air vent and the securing rod is moved to the extended position, the securing member of the securing rod extends into the air vent, and wherein subsequent movement of the securing rod toward the retracted position under the influence of the biasing member is operable to engage the securing member with a portion of the air vent to secure the cage member to the air vent.

2. The air vent attachment of claim 1, wherein the securing rod extends through the cage member and the cage member is slidable with respect to the securing rod.

3. The air vent attachment of claim 2, wherein at least one of the inner and outer surface of the cage member support a central hole within which the securing rod is movable.

4. The air vent attachment of claim 1, wherein a width of the securing rod is sized to fit between vanes of the air vent.

5. The air vent attachment of claim 4, wherein the securing member is a hook.

6. The air vent attachment of claim 5, wherein the outer end of the securing rod carries an outer handle.

7. The air vent attachment of claim 1, wherein the biasing member is a spring coil extending around the securing rod.

8. The air vent attachment of claim 1, wherein the cage member is frustoconical in shape where a broader end carries the inner surface and a narrower end carries the outer surface.

9. The air vent attachment of claim 1, wherein the inner and outer surfaces of the cage member are circular frames extending substantially parallel to each other, and wherein a number of support bars extend therebetween the circular frames.

10. The air vent attachment of claim 1, wherein a length of the securing rod is adjustable.

11. A method of drying an article of clothing, comprising the acts of:

providing a vent attachment comprising:

a cage member having at least one air conduit extending from an inner surface to an outer surface;

a securing rod having an inner end and an outer end, the inner end having a securing member and the outer end retaining the cage member; and a biasing member positioned between the cage member and the outer end of the securing rod to bias the cage member toward the inner end of the securing rod;

placing the inner surface of the cage member against an exterior surface of an air vent;

securing the securing rod to the air vent; and placing an article of clothing around the cage member to allow air to flow into a cavity of the article of clothing.

12. The method of claim 11 wherein at least one of the inner and outer surface of the cage member support a central hole supporting extension of the securing rod therethrough.

13. The method of claim 11 wherein the securing member is a hook and the securing rod is inserted through vanes of the air vent and rotated to hook the inner end of the securing rod to a vane of the air vent.

14. The method of claim 11 wherein the cage member is a frustoconical shape having a greatest diameter that is less than a diameter of an opening of the article of clothing.

15. The method of claim 11 wherein the article of clothing is a glove and an opening of the glove receives the cage member.

16. An air vent attachment comprising:

a cage member having at least one air conduit extending from an inner surface to an outer surface, the inner surface configured to abut an exterior surface of an air vent and the outer surface configured to be distanced from the exterior surface of the air vent; and a securing member configured to retain the cage member against the exterior surface of the air vent, wherein the securing member is movable relative to the cage member between an extended position and a retracted position, wherein when the securing rod is in the extended position an inner end defined by the securing member extends past the inner end of the cage member;

wherein when the inner surface of the cage member is positioned against the exterior surface of the air vent and the securing rod is moved to the extended position, the securing member of the securing rod extends into the air vent, and wherein subsequent movement of the securing rod toward the retracted position is operable to engage the securing member with a portion of the air vent.

17. The air vent attachment of claim 16 wherein the securing member is a securing rod slidably coupled to the cage member.

18. The air vent attachment of claim 17 wherein the securing rod extends from the outer surface to the inner surface of the cage member.

19. The air vent attachment of claim 17 wherein the inner end of the securing rod includes a hook adapted to hook the securing rod to at least one vane of the air vent.

20. The air vent attachment of claim 16 including a biasing arrangement interposed between the cage member and the securing member for biasing the cage member toward the exterior surface of the air vent.

* * * * *